United States Patent [19]

Bakker et al.

[11] 4,168,570

[45] Sep. 25, 1979

[54] SHAVING APPARATUS

[75] Inventors: Eppe Bakker; Wytse Bergsma; Pieter Riemersma, all of Drachten, Netherlands

[73] Assignee: U.S. Philips Corporation, New York, N.Y.

[21] Appl. No.: 873,104

[22] Filed: Jan. 30, 1978

[30] Foreign Application Priority Data

Apr. 25, 1977 [NL] Netherlands ..... 7704475

[51] Int. Cl.[2] ..... B26B 19/14

[52] U.S. Cl. ..... 30/43.6

[58] Field of Search ..... 30/43.5, 43.6, 43.4

[56] References Cited

U.S. PATENT DOCUMENTS

| | | | |
|---|---|---|---|
| 3,233,323 | 2/1966 | Driessen | 30/43.6 X |
| 3,844,033 | 10/1974 | Yonkers | 30/43.6 |
| 3,913,225 | 10/1975 | Tietjens | 30/43.6 |
| 4,001,932 | 1/1977 | Herrick | 30/43.5 |
| 4,087,909 | 5/1978 | Naemura | 30/43.6 |

*Primary Examiner*—Jimmy C. Peters

*Attorney, Agent, or Firm*—Thomas A. Briody; William J. Streeter; Rolf E. Schneider

[57] ABSTRACT

A shaving apparatus comprises a shaving cap provided with a flange extending outwardly within a housing; a cutting member rotatable relative to the shaving cap and spring-urged into engagement therewith, such shaving cap being inwardly depressable against the spring; two diametrically opposite stops provided in the housing adjacent the flange; and a third stop provided in the housing also adjacent the flange, whereby the cap can be pivoted about the diametrically opposite stops.

1 Claim, 8 Drawing Figures

SHAVING APPARATUS

This invention relates to a shaving apparatus, which comprises a housing, a stationary cutting member, and a drivable cutting member, the stationary cutting member taking the form of a cap in which hair-entrance apertures are formed, which cap is situated with a rim inside the housing and is depressable in an inward direction relative to the housing against spring force.

Such a shaving apparatus is for example, known from U.S. Pat. No. 3,913,225. In this apparatus the caps are supported by resilient means, so that the caps are adjustable relative to the skin surface being shaved. The caps are then almost completely pressed into the housing, whilst for an optimum shaving action it is essential that the caps at least partly project from the housing over a specific distance.

It is an object of the present invention to eliminate this drawback and this leads to a construction which is characterized in that the housing is provided with a stop at the location of the rim of the cap, and the cap is pivotable about the stop upon contact between the stop and the rim.

With the aid of the stop it can be achieved that at least a part of the cap projects so far from the housing as is necessary for a satisfactory shaving action. Owing to the pivotal movement about this stop, the cap remains adjustable under the influence of the forces exerted on it during shaving.

A special embodiment is characterized in that the stop is adjustable.

The cap may be pivotable about two stops. A corresponding embodiment is characterized in that under the influence of the spring force the cap engages with the two stops with a flanged rim and is pivotable relative to these stops with the aid of an adjustable third stop.

Shavers provided with two or more caps may be designed so that they are characterized in that the caps are pivotable in a position in which corresponding parts of each cap, which are disposed near a housing portion which is centrally disposed relative to the caps, project further or less far from the housing than the other portions of the caps.

A further preferred embodiment is characterized in that the caps comprise jointly adjustable stops.

Alternatively, the caps may jointly be supported by a resilient element, whose arms may engage with the rims of the caps, the end of an arm being disposed in a groove in the cap rim.

The invention will now be described in more detail with reference to the accompanying drawings, in which.

Figure 7:
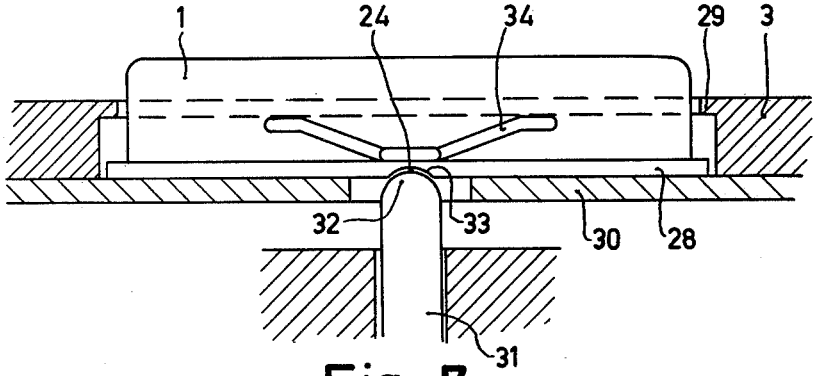
Figure 8:
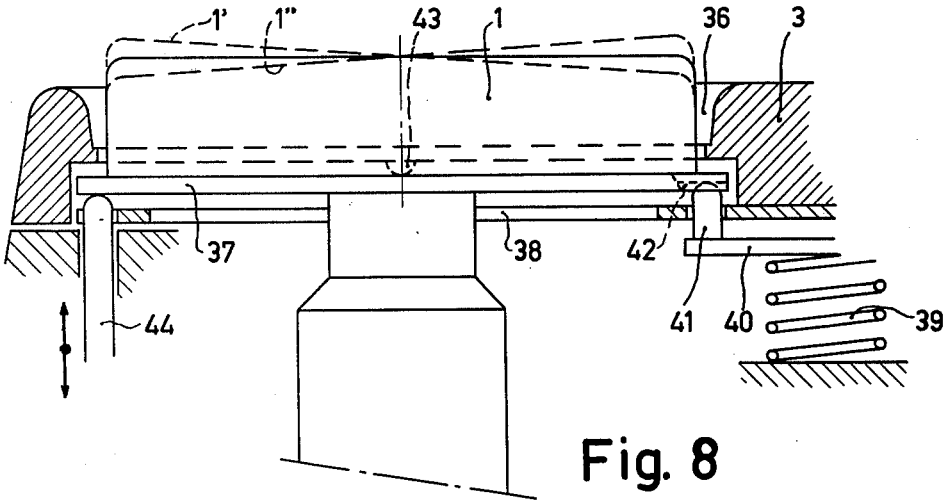

FIGS. 7 and 8 each show a cap and adjoining housing parts of other embodiments.

Figure 1:
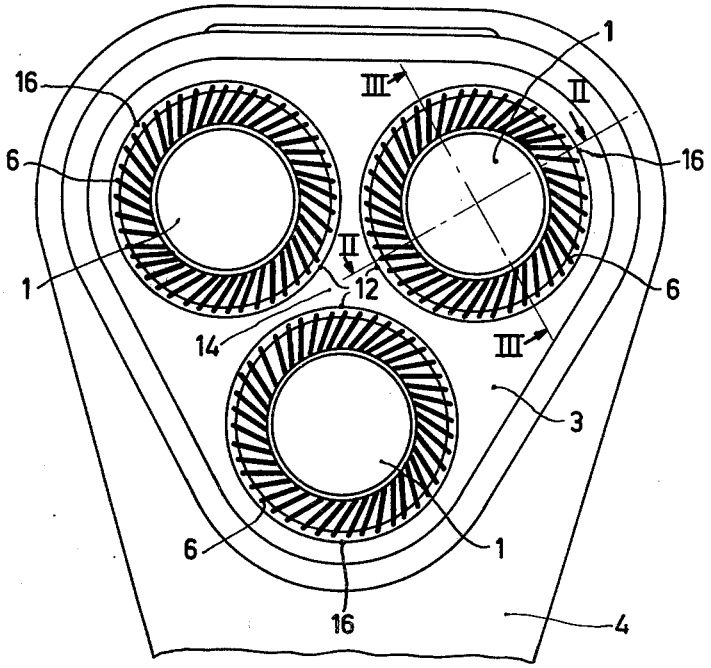
FIG. 1 is a plan view of a shaving apparatus with three caps.
Figure 2:
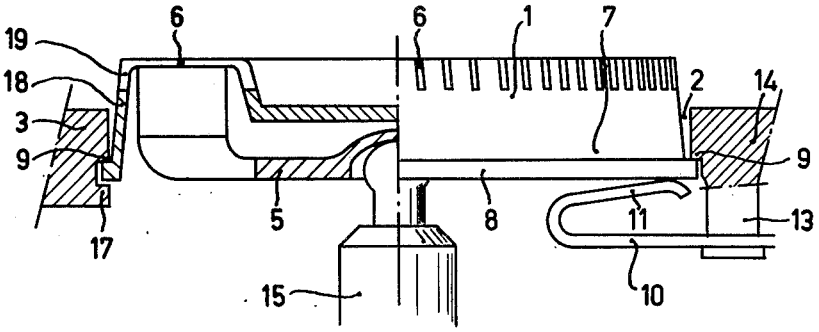
FIG. 2 is a detailed cross-section taken on the line II—II in FIG. 1.
Figure 3:
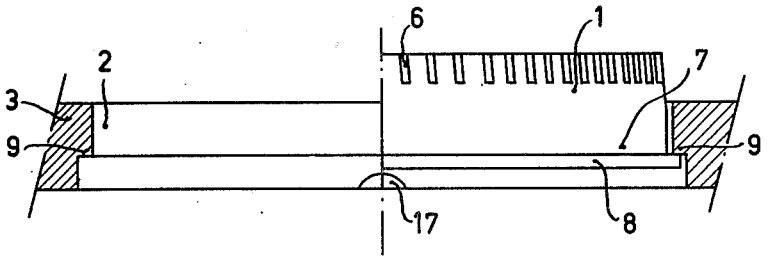
FIG. 3 is a detailed cross-section taken on the line III—III in FIG. 1, the cap being omitted in the left part of the Fig.

In the embodiment of FIGS. 1 through 3, the caps 1 are disposed in the openings 2 of a cap holder 3. The cap holder 3 forms part of the housing 4, which also accommodates the motor, not shown, for driving the rotatable cutting members 5.

The caps have hair-entrance apertures 6 and are respectively disposed inside the housing 4 with a rim 7. The rim 7 is provided with a flange 8, which engages with the receding rim 9 of the cap holder 3 in the position in which the cap projects as far as possible.

The caps are respectively supported by a resilient element 10 which for each cap is provided with a resilient arm 11 which engages with the rim 7 at the location 12. With the aid of the pin 13 the resilient element is secured to a member 14, which is centrally disposed relative to the caps.

The cutting member 5 also exerts an outwardly directed resilient force on the cap 1, because the drive spindle 15 for the cutting member 5 is axially supported by a resilient element, not shown. It is possible to support the cap 1 resiliently via the cutting member 5 only, but the forces between the cap 1 and the cutting member 5 are then substantially greater than is necessary for a satisfactory cutting action between the cap and the cutting member, which is attended by high frictional losses, heat development and wear.

At the location 16 on the circumference of the respective caps the cap holder 3 is provided with stops 17. These stops limit the distance over which the caps can be pressed inwards under the influence of the forces exerted on them during shaving. Thus, it can be achieved that locally the part of the side walls 18 of the respective caps, in which the ends 19 of the hair entrance apertures 6 are disposed, always projects from the housing, which is beneficial for catching beard hairs to be shaved.

If the caps 1 are pressed so far inwards that the flange 8 engages with the stop 17, the caps 1 are pivotable about these stops. A position may then for example be reached in which the cap portion at the location 16 projects further from the housing than the cap portion near the central portion 14. In this situation the position of the caps is adapted for shaving convex skin surfaces.

The apparatus may also be designed in such a way that the caps 1 are pivotable about a fixed stop at the location 12, so as to enable the caps to adjust themselves to a concave skin surface.

Figure 4:
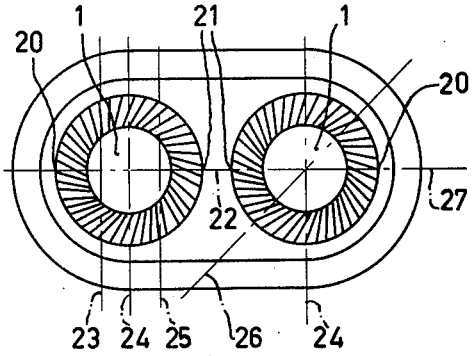
FIG. 4 is a plan view of an embodiment with two caps.
Figure 5:
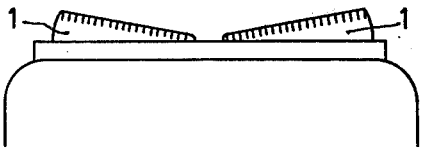
FIGS. 5 and 6 are side views of embodiments with two caps.
Figure 6:
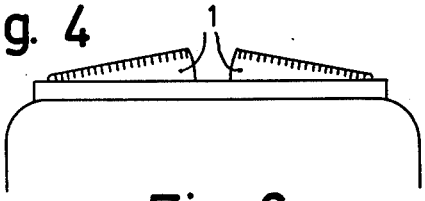

The adjustment capability of the caps to a concave or a convex skin surface is further illustrated by means of FIGS. 4 , 5 and 6, which relate to a shaving appartus with two caps. When the caps 1 are respectively pivotable about a fixed stop at the location 20, a position can be assumed for shaving a convex skin surface, as is shown in FIG. 5. When the caps are respectively pivotable about a stop at the location 21 near the central portion 22, the position of the caps can be adapted for shaving a concave skin surface, as is indicated in FIG. 6.

In the embodiments of FIGS. 1 through 6 the stops may be adjustable so that the distance over which the cap is pressed inwards is variable. In the case that the apparatus comprises two or more caps, the adjustable stops are preferably coupled to a common actuating mechanism with an actuating member on the housing wall.

It is alternatively possible to provide two stops per cap, the cap being pivotable about a pivoting axis which is determined by the two stops, if the rim of the cap engages with these stops. In FIG. 4 some pivoting axes which are possible are designated 23 through 27.

The pivoting axis 24 concerns an embodiment which is further elaborated in FIG. 7. In this Fig. the cap holder 3 is shown in cross-section, but this is not the case with the cylindrical cap 1. In this case the cap is retained between the rim 29 of the cap holder 3 and a retaining plate 30 by means of the flange 28. The flange 28 bears on two diametrically opposed stops 31. The rounded ends 32 of the stops engage with recesses 33 in the flange 28, so that the cap is secured against rotation. Owing to resilient elements 34, which are tensioned between the flange 28 and the rim 29, the flange 28 always remains in contact with the stops 31, because the inwardly directed forces exerted on the cap by said resilient elements 34 are greater than the outwardly directed force which is exerted on the cap via the cutting member, which is not show for the sake of simplicity. The cap is then rotatable about the pivoting axis 24 which is defined by the ends of the stops 31.

In the case of two stops per cap at least one stop per cap may also be adjustable and a plurality of adjustable stops may be coupled to a common acutating mechanism.

The embodiment of FIG. 8 also concerns a shaving apparatus with two or more shaving heads 1, only one of which is shown. The shaving head is located in an opening 36 of the shaving cap holder 3 and is retained between the holder 3 and a plate 38 with the aid of a flange 37. The cap is resiliently loaded, in known manner, via the drivable cutting member and by a central spring 39 to which a cup 40 is secured with a pin 41 for each cap. The pin 41 engages with a groove 42 of the flange 37, so that the cap is also locked against rotation.

Owing to the resilient support the flange 37 of the cap 1 is urged against two diametrically opposed stops 43 of the holder 3. The stops 43, one of which is shown dotted, are disposed at the edge of the opening 36 and allow the cap 1 to be tilted about the stops 43. At a location opposite the pin 41 the flange 37 engages with a third stop 44. This stop 44 is adjustable in the direction of the arrow, so that the cap 1 can assume different positions by pivoting about the stop 43, two of these positions being designated by dashed lines 1' and 1''.

What is claimed is:

1. A shaving apparatus which comprises a housing, a stationary cutting member in the form of a cap having hair entrance apertures and provided with an outwardly extending flange within the housing, a rotatable cutting member, spring means urging said rotatable cutting member into engagement with the stationary cutting member, said stationary cutting member being depressable in an inwardly direction relative to the housing against said spring means, two diametrically opposite stops being provided in the housing at locations adjacent the cap flange, and a separate third stop provided in the housing also at a location adjacent the cap flange, said cap being pivotable about the two diametrically opposite stops, upon contact between said two stops and the cap flange, with the aid of said third stop.

* * * * *